United States Patent [19]

Gostelow

[11] Patent Number: 4,653,463

[45] Date of Patent: Mar. 31, 1987

[54] HOB FOR A GAS COOKER

[75] Inventor: Benjamin F. Gostelow, Warrington, England

[73] Assignee: TI New World Limited, Warrington, England

[21] Appl. No.: 783,316

[22] Filed: Sep. 13, 1985

[30] Foreign Application Priority Data

Sep. 17, 1984 [GB] United Kingdom ..... 8423412

[51] Int. Cl.[4] ..... F24C 3/00

[52] U.S. Cl. ..... 126/39 H; 126/39 N; 126/214 R

[58] Field of Search ..... 126/39 R, 39 E, 39 C, 126/39 F, 39 H, 39 K, 39 N, 214 R, 214 A–214 D, 211, 215; 431/193; 239/554, 555, 558

[56] References Cited

U.S. PATENT DOCUMENTS

| | | | |
|---|---|---|---|
| 2,595,005 | 4/1952 | Shelton et al. | 126/39 N |
| 3,186,472 | 6/1965 | Caravella | 126/39 H |
| 3,455,290 | 7/1969 | Kemp | 126/39 H |
| 3,619,099 | 11/1971 | Moss | 126/39 H X |
| 3,645,249 | 2/1972 | Henderson et al. | 126/39 H |
| 3,922,138 | 11/1975 | Biddle et al. | 126/39 R X |
| 4,354,478 | 10/1982 | Contini | 126/39 E |
| 4,413,611 | 11/1983 | Berlik et al. | 126/39 E |

FOREIGN PATENT DOCUMENTS

| | | | |
|---|---|---|---|
| 2819118 | 10/1979 | Fed. Rep. of Germany | 126/39 H |
| 808323 | 2/1959 | United Kingdom . | |
| 863914 | 3/1961 | United Kingdom | 126/39 E |
| 918324 | 2/1963 | United Kingdom . | |
| 1008770 | 11/1965 | United Kingdom . | |
| 1224218 | 3/1971 | United Kingdom . | |

*Primary Examiner*—Margaret A. Focarino

*Attorney, Agent, or Firm*—Mason, Fenwick & Lawrence

[57] ABSTRACT

A gas hob comprises a spillage tray (8) apertured to receive gas burner heads (18) supplied with gaseous fuel via passages formed between the spillage tray and a plate (32) secured to the undersurface of the tray by a suitable adhesive. The plate is preferably of an organic material based on hydraulic cement examples of which are described in European Patent Applications Nos. 80.301909.0 (0 021 682) and 81.301228.3 (0 038 126).

14 Claims, 3 Drawing Figures

HOB FOR A GAS COOKER

BACKGROUND OF THE INVENTION

This invention relates to hobs and has particular reference to gas cooking hobs.

The hob may be an independent unit mounted in an aperture in the work surface of a kitchen unit or it may be part of a gas cooker. The hob is relatively deep in order to accommodate gaseous fuel supply conduits that feed fuel to gas burners mounted upon the upper surface of the spillage tray of the hob. Such a relatively deep unit has to be housed, at least in part, in the space beneath the work surface and this reduces the storage capacity of the unit.

SUMMARY OF THE INVENTION

According to the present invention, a gas hob comprises a spillage tray, with spaced apertures, burner heads mounted over the apertures, and gaseous fuel supply passages leading to the apertures and formed between the spillage tray and a plate or plates sealed to the undersurface of the spillage tray by an adhesive.

The adhesive may also secure the or each plate to the spillage tray.

The plate or plates may be or are contoured to provide at least one recess which, with the spillage tray, form the supply passages.

The or each supply passage may have a venturi-shaped portion and a portion for mixing gaseous fuel and entrained air.

The spillage tray may have a peripheral region contoured to provide, with the or each plate the venturi portions of the supply passages.

The peripheral region may be part of a peripheral margin round a central area of the spillage tray that is raised relative to the peripheral margin.

The peripheral margin may slope downwardly from the central area.

Preferably, the plate or plates is or are also contoured to produce surfaces which define those areas to be sealed or sealed and secured by the adhesive to the spillage tray.

The or each plate may be secured or further secured to the spillage tray by mechanical means which may include screws located at points adjacent the supply passages.

The adhesive may be a silicone based adhesive or a toughened adhesive containing resilient particles.

The or each plate may be of sheet metal but alternatively may be of an organic material based on hydraulic cement and could be one of those organic materials described in European Patent Application Nos. 80.301909.0 (0 021 682) and 81.301228.3 (0 038 126).

In one embodiment of the invention, the burner heads are thermally insulated from the spillage tray.

Preferably, the hob also includes an enclosure housing the spillage tray and plate or plates as well as a gas rail and injectors via which gaseous fuel is supplied to the passages. The flow of fuel from the rail to the injectors is controlled by gas taps with control knobs located along one side of the spillage tray and whose spindles pass through apertures in the spillage tray.

The spillage tray is normally of sheet metal although other materials may also be used. For example, the spillage tray may be of a heat-resisting ceramic or of toughened glass. The plate or plates may be of sheet metal.

BRIEF DESCRIPTION OF THE DRAWINGS

By way of example only, a gas hob embodying the invention will now be described in greater detail with reference to the accompanying drawings of which.

DETAILED DESCRIPTION OF THE PREFERRED EMBODIMENT

Figure 1:
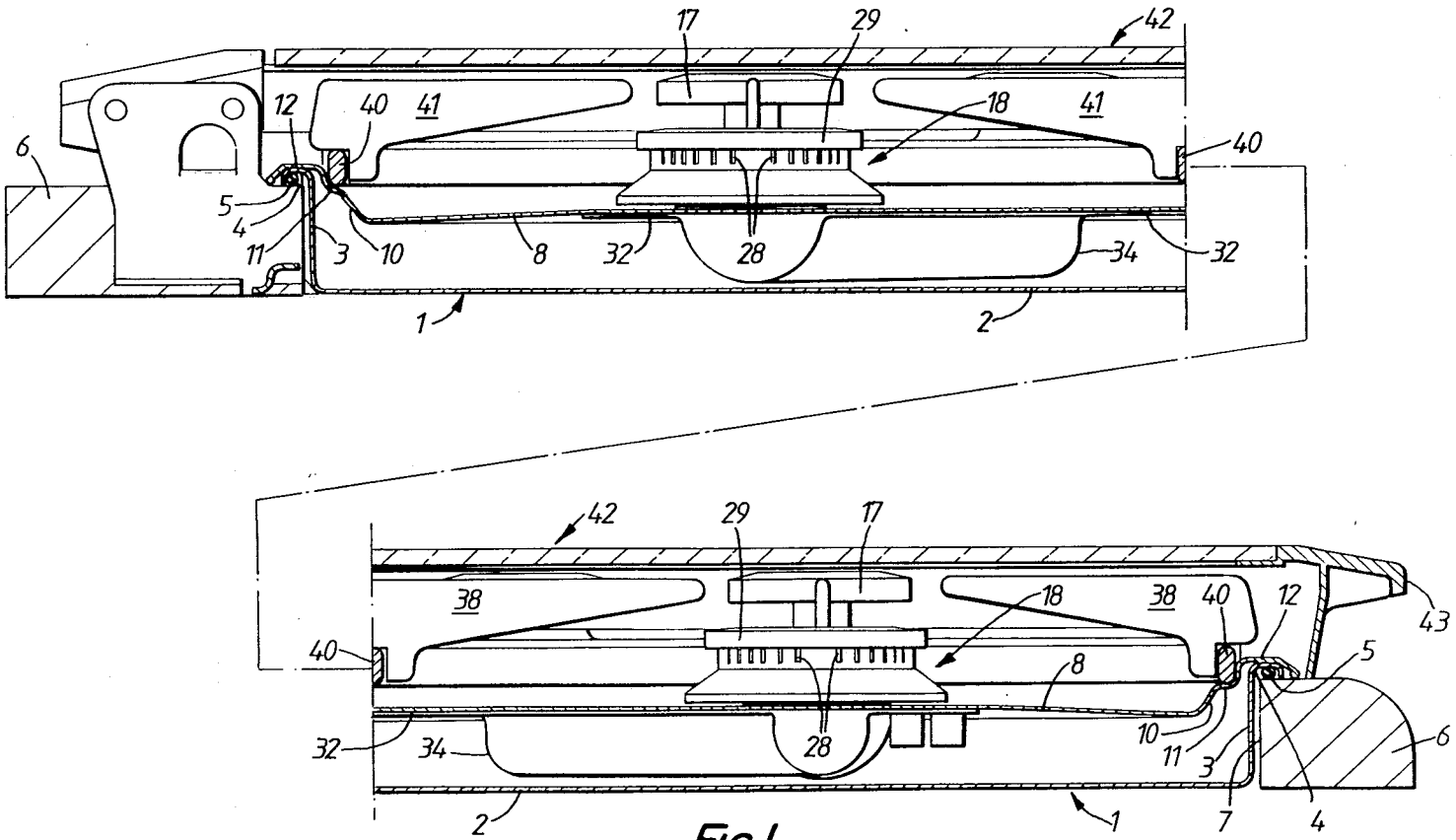
FIG. 1 is a view from one side of the hob mounted in a work surface, part only of which is shown.

The hob comprises a shallow open-topped box 1 with a rectangular base 2 and upstanding side walls 3 on each side of the base. The side walls are outwardly flanged as at 4 to form a downwardly open channel within which is accommodated a sealing strip 5 of a heat resisting resilient material for example a silicone rubber. The sealing strip 5 is compressed within the channel by the edge of a work surface 6 surrounding an aperture 7 in the latter within which the hob is mounted.

The open top of the box 1 is closed by a rectangular spillage tray 8 apertured as at 9 and with an upwardly and outwardly sloping peripheral wall 10. The wall 10 is stepped as at 11 and its edge is contoured to form a downwardly-open channel 12 that rests upon the flange 4. Along one of its side edges the spillage tray is contoured to form a control panel 13 raised slightly above the upper level of surface 6 as can be seen from FIG. 2. The panel 13 is apertured at spaced intervals to accommodate the upwardly-extending control spindles 14 of gas taps that control the flow of gas from a gas rail 15 to injectors 16. The spindles 14 carry control knobs 17 by which a user operates the gas taps. The gas rail is supported upon brackets 40 fixed to the undersurface of the spillage tray 8.

Figure 2:
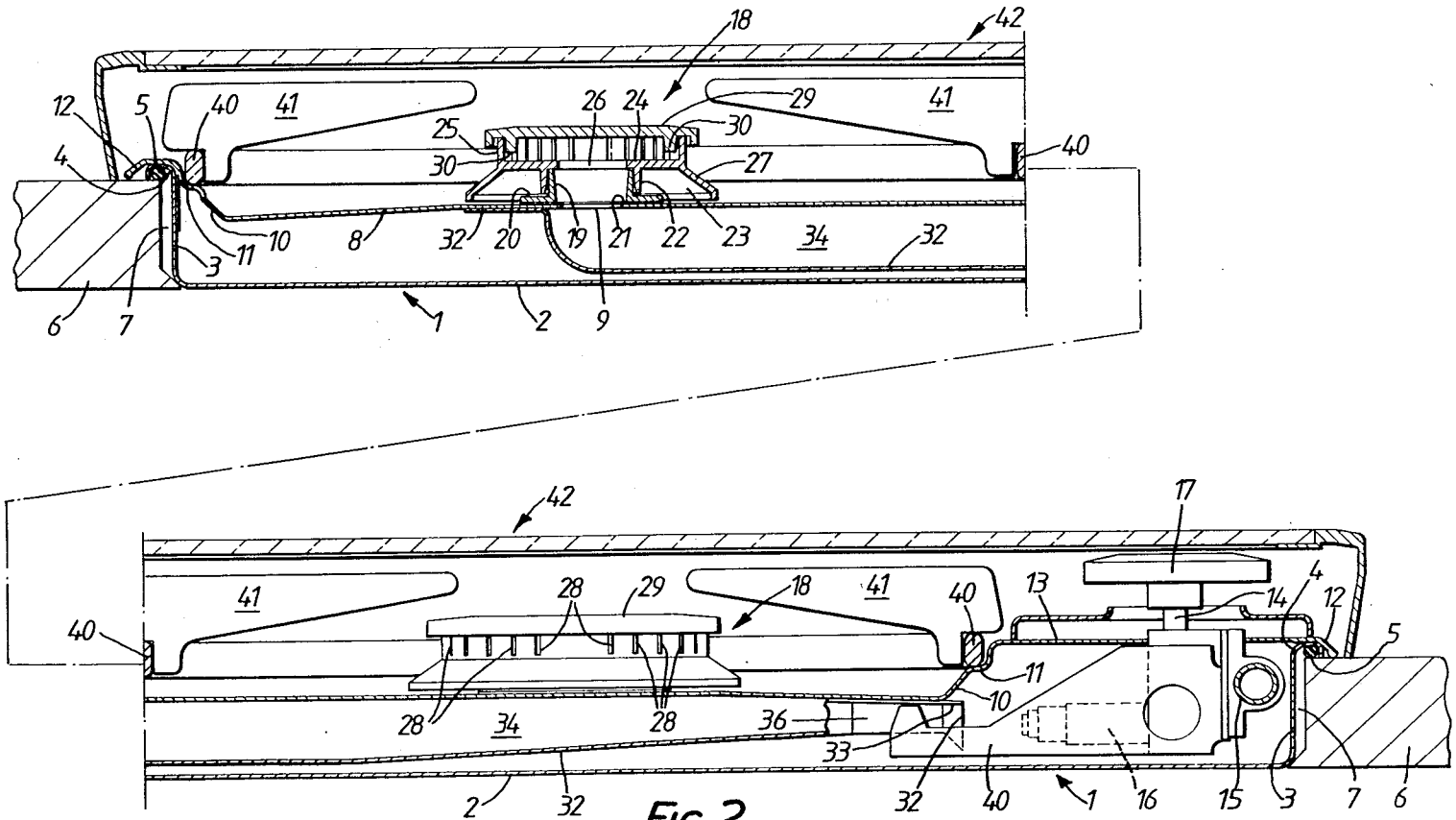
FIG. 2 is a view, partly in section, from one end of the hob.

The central area of the spillage tray is raised slightly as can be seen from FIGS. 1 and 2, the apertures 9 being located in the raised area. The downwardly-sloping margin round the raised area ensures that any spillage that occurs is directed towards the periphery of the spillage plate. The periphery of the spillage plate is cooler than the raised area when the hob is in use, and by directing spillage away from the hotter area, the risk of spillage 'burning on' to the surface of the spillage plate is reduced.

In addition, the contour of the sloping margin of that part of the spillage plate adjacent the control panel 13 is chosen to provide, as will be described below, the upper surface of venturi and mixer tubes.

Finally, the particular contouring of the spillage plate controls the direction in which the plate tends to distort when heated, and knowledge of this enables the remainder of the hob structure to be designed to accommodate such distortion when it occurs.

Located centrally over the apertures 9 are gas burners 18 one of which is shown in section in FIG. 2. Each burner 18 comprises a locating boss 19 with an outwardly projecting flange 20 at its lower end (as seen in FIG. 2) and by means of which, and in a manner not shown, the boss is secured to the spillage tray 8. A gasket 21 of a flexible heat-resistant, thermally insulating material is interposed between the flange 20 and the spillage tray 8. Engaged telescopically with the boss 20 is the boss 22 of a burner body member 23. The boss 22 projects downwardly from a horizontal partition 24 within the member 23. The partition 24 has a peripheral upstanding wall 25 and is apertured centrally as at 26. The wall 25 also extends downwardly beyond the partition 24 where it forms an outwardly inclined skirt 27 that conceals the telescopically engaged bosses 19 and 22. The wall 25 is slotted at intervals to form flame ports 28 and the upper edge of the wall supports a cap 29. Projecting from the undersurface of the cap 29 are diametrically opposite pegs 30, positioned to locate just inside the upper part of the wall 25. The pegs 30 ensure the correct location of the cap 29. The cap 29 also has a downwardly-projecting flange 31 which acts as a scraper ring to create retention and cross linking flames between the flame ports 28.

Secured to the underside of the spillage tray 8 is a rectangular plate 32 whose superficial area is somewhat less than that of the spillage tray 6. As can be seen from FIG. 2, one edge 33 of the plate 32 lies adjacent the injectors 16.

The plate 32 is contoured to provide four spaced depressions 34 that extend from the edge 33 and each of which terminates adjacent a different one of the apertures 19. The depressions 34 are shaped to form, with that part of the downwardly-sloping margin of the spillage tray 8 adjacent the control panel 13, gaseous fuel passages each with an entrance 35, a venturi portion 36 and a mixing chamber 37. Each of the entrances 35 is aligned with a different one of the injectors 16.

Figure 3:
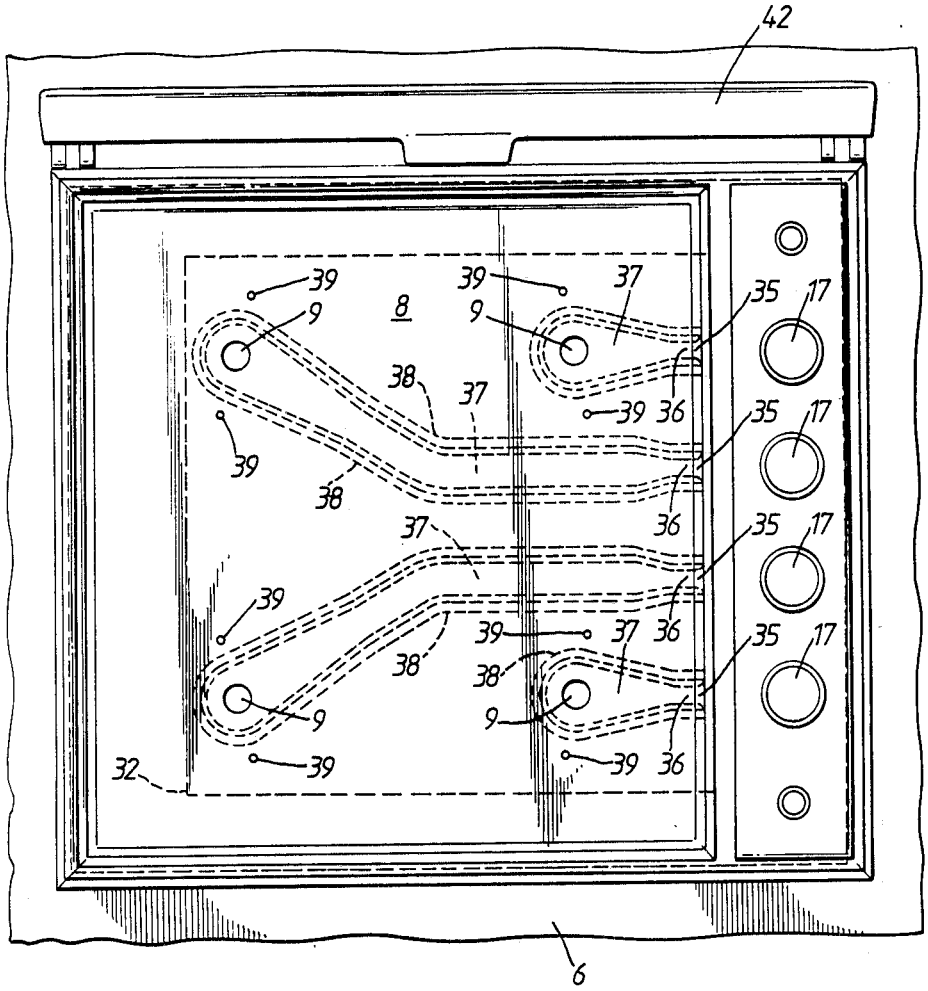
FIG. 3 is a plan view of the hob with certain components removed.

The plate 32 is of sheet metal and is sealed and secured to the undersurface of the spillage tray 8 by means of a suitable adhesive dealt with in more detail below. Those parts of the plate 32 immediately surrounding the depressions are formed to provide shallow recesses which define those areas of the plate to be sealed and secured to the undersurface of the spillage tray 8. Such areas are indicated in FIG. 3 by the dotted lines 38. The areas 38 lie between the respective depressions 34 and the remainder of the plate. Thus, the adhesive operates not only to seal the separate gaseous fuel passages and prevent leakage of gaseous fuel therefrom but also to attach the plate 32 to the undersurface of the spillage tray 8.

If desired, the attachment of the plate 32 to the spillage tray 8 may be effected by or consolidated by mechanical means, for example nuts and bolts indicated schematically at 39 in FIG. 3. As can be seen from FIG. 3, the nuts and bolts are located at positions clear of the gaseous fuel passageways.

Resting on the stepped parts 11 of the walls 10 of the spillage tray 8 is a frame 40 carrying pan supports 41 located, in conventional manner, round each burner 18.

When not in use, the hob is covered by a lid 42 pivotally attached to the box 1 at the rear thereof. The front edge of the lid has a handle 43 by which a user can swing the lid from the closed position shown in FIG. 1 to an open position shown in FIG. 3 and in which the lid is in a vertical position at the rear of the hob so giving complete access to the burners and controls. Preferably, the closing movement of the lid is restrained by, for example, the mechanism described in co-pending U.K. patent application No. 84,24904 (Case TINW 139).

The adhesive is a silicone based adhesive and provides a slightly flexible bond between the spillage tray and the plate. Such an adhesive will accommodate slight movement of the spillage tray relatively to the plate which may result from temperature gradients between the tray and the plate.

Alternatively, other adhesives, which may include toughened adhesives which are epoxy resin and acrylic adhesives to which resilient particles, for example rubber particles, have been added to stop the promulgation of cracks through the adhesive once it has been set or cured, can be used instead.

Many different adhesives for securing components together are now available but it may be thought that such adhesives would not be reliable in the environment of a gas hob due to the working temperatures of the latter. However, it is found, surprisingly, that such adhesives are reliable. This is thought to be due to the lower working temperatures of the hob which result from the construction described above. Heat transfer from the burners 18 to the spillage tray is limited by the gaskets 21. Further cooling of the spillage tray results from the flow of gaseous fuel along the gaseous fuel passageways of which the spillage tray itself forms one wall. Such cooling is maximised by ensuring maximum intake of primary air.

The burner heads and ports are designed to produce flames that have a flat attitude and this tends to encourage a greater flow of secondary air which, as it flows over the spillage tray, helps to keep the latter cool.

Furthermore, the use of adhesive to seal and secure the spillage tray and plate together does not result in distortion of those plates as would occur if they were both of sheet metal and secured together by a welding process.

The sandwich construction provided by the spillage tray-plate assembly ensures a rigid assembly and one that can be put together by automatic machinery.

It is also envisaged that materials other than those described above may be used for the spillage tray and plate. The spillage tray may be of a ceramic material or a toughened glass while the support plate may be of sheet metal.

The construction described above may, when suitably modified, be used for a hob incorporating both gas burners and electric radiant rings and/or solid plates.

In such a case, a single plate may be used. Part of the plate is contoured to provide depressions similar to depressions 34 referred to above and which provide feed passages for gaseous fuel. Another part of the plate may have a rectangular or other shaped recess large enough to accommodate one or more electric rings and/or solid plates.

Although a one-piece plate has been used in the hob described above, this is not essential. Several plates may be used, each having at least one depression, to form fuel supply passages with the spillage tray.

The support plate is of a high strength organic material based on hydraulic cement with a small amount of organic rheological aid. The material and its production are described in more detail in European Patent Application Nos. 80.301909.0 (0 021 682) and 81.301228.3 (0 038 126).

In addition, although the embodiments described above are built-in hob units, the invention can be incorporated in a free-standing cooker with such changes as may be necessary to adapt the hob construction for inclusion in the cooker. In the latter case, the hob may incorporate both gas burners and electric rings or solid plates.

I claim:

1. A hob comprising:

an upper spillage tray forming a cooking top and having spaced apertures therein;

a respective gas burner and a respective fuel supply passage for each aperture, the burner being mounted over the aperture and the passage being located under the cooking top and terminating at the aperture to convey gaseous fuel to the burner, each supply passage having a venturi-shaped portion and a portion for mixing gaseous fuel and entrained air;

wherein at least one plate is secured to the undersurface of the cooking top, the or each plate being contoured to provide at least one recess which, with the cooking top, forms one of the supply passages, the plate(s) being sealed to the undersurface by an adhesive.

2. A hob as claimed in claim 1 in which the adhesive also secures the or each plate to the cooking top.

3. A hob as claimed in claim 1 in which the cooking top has a peripheral region contoured to provide, with the plate, the venturi portion.

4. A hob as claimed in claim 3 in which the peripheral region is part of a peripheral margin round a central area of the cooking top raised relative to the peripheral margin.

5. A hob as claimed in claim 4 in which the peripheral margin slopes downwards from the central area.

6. A hob as claimed in claim 1 in which the or each plate is also contoured to define areas to be sealed, or sealed and secured, to the cooking top by the adhesive.

7. A hob as claimed in claim 8 in which the areas lie adjacent the recesses.

8. A hob as claimed in claim 1 and further comprising an enclosure housing the cooking top, the plate or plates and a gas rail and injectors via which gaseous fuel is supplied to the passages.

9. A hob as claimed in claim 1 in which the or each plate is secured or further secured to the cooking top by mechanical means.

10. A hob as claimed in claim 9 in which the mechanical means comprise screws located at points adjacent the supply passages.

11. A hob as claimed in claim 1 in which the adhesive is a silicone based adhesive.

12. A hob as claimed in claim 1 in which the adhesive is a toughened adhesive containing resilient particles.

13. A hob as claimed in claim 1 in which the or each plate is of sheet metal.

14. A hob as claimed in claim 1 in which the or each plate is of an organic material based on hydraulic cement.

* * * * *